US010617904B2

(12) United States Patent
Chiavegato et al.

(10) Patent No.: US 10,617,904 B2
(45) Date of Patent: Apr. 14, 2020

(54) EXERCISE MACHINE

(71) Applicants: Mattiarmando Chiavegato, Tolmezzo (IT); Alessandro Englaro, Padua (IT)

(72) Inventors: Mattiarmando Chiavegato, Tolmezzo (IT); Alessandro Englaro, Padua (IT)

(73) Assignee: AKUIS S.R.L., Tolmezzo (UD) (IT)

( * ) Notice: Subject to any disclaimer, the term of this patent is extended or adjusted under 35 U.S.C. 154(b) by 70 days.

(21) Appl. No.: 16/074,572

(22) PCT Filed: Dec. 20, 2016

(86) PCT No.: PCT/EP2016/082603
§ 371 (c)(1),
(2) Date: Aug. 1, 2018

(87) PCT Pub. No.: WO2017/133823
PCT Pub. Date: Aug. 10, 2017

(65) Prior Publication Data

US 2019/0046830 A1 Feb. 14, 2019

(30) Foreign Application Priority Data

Feb. 3, 2016 (EP) ..... 16425018

(51) Int. Cl.
*A63B 21/062* (2006.01)
*A63B 21/00* (2006.01)
(Continued)

(52) U.S. Cl.
CPC ..... *A63B 21/0628* (2015.10); *A63B 21/154* (2013.01); *A63B 21/156* (2013.01);
(Continued)

(58) Field of Classification Search
CPC . A63B 21/0628; A63B 21/154; A63B 21/156; A63B 21/4034; A63B 21/4035;
(Continued)

(56) References Cited

U.S. PATENT DOCUMENTS 4,402,504 A 9/1983 Christian
4,549,733 A 10/1985 Salyer
(Continued)

OTHER PUBLICATIONS

Int'l Search Report and Written Opinion dated May 4, 2017 in Int'l Application No. PCT/EP2016/082035.
Int'l Preliminary Report on Patentability dated May 4, 2018 in Int'l Application No. PCT/EP2016/082035.

*Primary Examiner* — Joshua Lee
(74) *Attorney, Agent, or Firm* — Panitch Schwarze Belisario & Nadel LLP

(57) ABSTRACT

Machine for gymnastic exercises comprising a sliding rail (3), a carriage (4) installed in a sliding manner on the sliding rail (3), a first pulley (21) and a second pulley (22) installed on the carriage (4) and rotatable in an idle manner around respective axes of rotation, a gripping element (6), cable traction means (16) comprising a first cable branch (a) and a second cable branch (b) provided with respective and separate connection ends (17) attached to the gripping element (6). The first cable branch (a) and the second cable branch (b) wind at least partly around the first pulley (21) and respectively the second pulley (22) to define first return segments (23) comprised between the gripping element (6) and respectively the first pulley (21) and second pulley (22), and second return segments (24) that extend one on a first side (25) and the other on a second side (26), opposite the first side (25), of the carriage (4) and substantially parallel to the sliding rail (3).

9 Claims, 8 Drawing Sheets

(51) Int. Cl.
*A63B 24/00* (2006.01)
*A63B 71/00* (2006.01)

(52) U.S. Cl.
CPC ..... *A63B 21/4034* (2015.10); *A63B 24/0062* (2013.01); *A63B 24/0087* (2013.01); *A63B 21/4035* (2015.10); *A63B 21/4043* (2015.10); *A63B 2024/0093* (2013.01); *A63B 2071/0081* (2013.01); *A63B 2220/13* (2013.01); *A63B 2220/16* (2013.01)

(58) Field of Classification Search
CPC ..... A63B 21/4043; A63B 24/0062; A63B 24/0087; A63B 2024/0093; A63B 2071/0081; A63B 2220/13; A63B 2220/16
See application file for complete search history.

(56) References Cited

U.S. PATENT DOCUMENTS

| | | | | |
|---|---|---|---|---|
| 5,271,416 | A | 12/1993 | Lepley | |
| 7,670,270 | B2 | 3/2010 | Alessandri et al. | |
| 8,485,951 | B1 * | 7/2013 | Adams | A63B 21/04 224/403 |
| 2013/0035220 | A1 * | 2/2013 | Adams | A63B 21/04 482/129 |
| 2014/0121071 | A1 | 5/2014 | Strom et al. | |
| 2016/0121156 | A1 * | 5/2016 | Bach | A63B 21/0087 482/112 |

* cited by examiner

EXERCISE MACHINE

CROSS-REFERENCE TO RELATED APPLICATION

This application is a Section 371 of International Application No. PCT/EP2016/082035, filed Dec. 20, 2016, which was published in the English language on Aug. 10, 2017, under International Publication No. WO 2017/133823 A1, which claims priority under 35 U.S.C. § 119(b) to European Application No. 16425018.5, filed Feb. 3, 2016, the disclosures of which are incorporated herein by reference in their entirety.

FIELD OF THE INVENTION

The present invention relates to exercise machines suitable for developing motor and functional abilities, muscular strength and for medical or rehabilitation purposes. In particular, the present invention relates to an exercise machine in which the user acts on one or more grip elements each connected, through one or more cable traction means, to a resisting load source.

BACKGROUND OF THE INVENTION

Functional strength exercise machines are known for allowing a user to perform complex movements relatively free in space, imitating traditional free weight exercises (dumbbells, barbells, etc.) with the possibility to perform an extended range of exercises. Those machines are generally composed by a resisting load carried to a grip element through a cable, typically sliding around a certain number of pulleys. The resistant load may be "generated" through weights stacks, resistance devices, pneumatic or electric actuators.

In this kind of machines, the resisting load (namely the force that the user perceives at the grip element and to which he must counteract to make a specific movement) always acts along the direction of the cable that carries the load to the grip element. Similarly, if the grip element involves more cables or more segments of the same cable (as an example, possible configurations are shown in FIG. 1), the resisting force direction perceived by the user is given by the vector sum, as shown in FIG. 1.

In U.S. Pat. No. 7,670,270 an exercising machine is disclosed, which is provided with a frame and with at least one operating apparatus. The at least one operating apparatus can be used to perform a physical exercise and comprises a load group supported by the frame and connected to the operating apparatus by means of at least one cable wound around a plurality of transmission members supported by the frame and arranged so as to define a path for the cable. The load group comprises at least two load units separated from each other and connected together by means of the cable and arranged at ends of the path on opposite sides of the operating apparatus so that the latter can be tensioned on respective opposite sides by means of different loads.

In U.S. Pat. No. 4,402,504 another example of exercising machine is disclosed, which comprises an elongated frame including an upper pulley and a lower pulley attached to the upper and lower portions of the frame, respectively. A resistance means operatively connected to the frame provides an exercising force in response to exercising motions of the user. A two-ended cable is trained around the upper and lower pulleys with its ends connected to the resistance means. A grip, slidably attached to an intermediate portion of the cable, is trained around and between two guide pulleys attached to a carriage that is carried by the frame. Guide pulleys guide the intermediate portion of the cable laterally outwardly form the carriage to provide a working loop for engagement by the grip. The height of the carriage is selectively adjustable relative to the frame. The length of the working loop remains substantially constant when not pulled, regardless of the height of the carriage. The resistance means may comprise resilient resistance straps, coiled springs or weights.

In US-A-2014/0121071 an exercise machine is disclosed which comprises a frame and a weight stack. The weight stack is positioned within a portion of the frame. The exercise machine further comprises a weighted cable having a first end configured for selective attachment to weight plates of the weight stack, a guide track defining a path, and a movable pulley assembly slidably coupled to the guide track. A positioning mechanism is coupled to the movable pulley assembly and configured to move and position the movable pulley assembly along the path defined by the guide track.

DRAWBACKS IN THE PRIOR ART

Since in conventional cable training machines the exit point of the cable from the device frame is stationary during an exercise (although it can be manually adjusted before the exercise), the actual direction of the resisting load depends on the position in space of the grip element. This implies that the user can control the resisting load direction only by assuming a specific position in the space and performing the exercise in a specific manner. For instance, if the user wanted to keep a constant direction of the resisting force for any position in the space, he would have to perform the exercise by moving the grip element parallel to the cable (in other words, he would have to manually keep the cable orientation constant in the space).

It is noticeable the difficulty to keep constant the resisting force direction, as on the contrary naturally occurs in conventional weightlifting with free weights, where the resisting load direction always points to the ground (according to earth's gravity).

Moreover, conventional exercise machines are cumbersome (the support frame is considerably greater than the actual working area available to the user) and heavy (the total weight is considerably higher than the weight/load available for the exercise) for intrinsic, structural and safety reasons.

Moreover, in conventional exercise machines comprising some means used as user interface with the machine to perform common tasks including starting the exercise, changing the resisting load, interrupting the exercise, those means are located on the machine frame, inhibiting the user from performing actions on said user interface while doing an exercise.

SCOPES OF THE INVENTION

It is made clear that the terms "vectoring", "vectoring the resisting load", often used here below, stand for the user's capability to control the resisting load he perceives at the grip element both in magnitude and in direction, and the term "vectoring system" stands for the system of means here disclosed, provided for achieving such capability. With magnitude is intended the weight or force perceived by the user at the grip element (e.g. 5 kg, 25 kg) and with direction is intended that the resisting load is acting along a desired direction, for example always towards the ground, or at any angle from the horizontal plane, for instance, at 40° degrees. The capability of vectoring the resisting load is substantially independent from user's position or movements. With load source it is intended the means or system of means suitable for applying a specified force on a cable. When referring to a plurality of load sources, each connected to a cable, it is intended that some mechanism is able to control the force on a cable independently from the other. Or if same forces are applied on both cables, such ends can move independently. The vectoring system behavior does not depend on the specific mechanisms involving the cables before the vectoring system itself provided that said mechanisms (egg. the pulleys, transmission mechanisms used to create complex cable paths before the vectoring system) are able to bring along the cables the force required to the vectoring system to work properly. When referring to a plurality of load sources, it is intended that each load source is independent from the other, in other words that the force of each load source is controllable independently.

The main object of the invention is to provide means for constructing exercise machines capable of vectoring the resisting load, giving to the user the perception of having to do with free weights (barbells, dumbbells, etc.) subject to earth's gravity, by constantly keeping the resisting load direction towards the ground, or allowing other particular effects and exercise types by varying the direction of the resisting load in a controlled manner.

Another object of the invention is getting the capability to move or hold the cable exit point to a specific position using only the load sources themselves, if electronically controllable.

Another object of the invention is getting the capability of using in the machines a series of particular electric motor configurations, whose purpose is to generate the resisting loads on the cables, to control the vectoring system and to act as sensors suitable for recognizing user gestures made for controlling the machine. Such capability may be implemented in any type of exercise machines having electronically controlled load sources. The peculiarity given by the preferred motor configurations is a flat and compact design of the motors, which leads to a flat design of the whole system. This contributes to the realization of a compact and light exercise machine.

Another object of the invention is the kind of grip elements that incorporate safety, exercise control and feedback devices communicating with a central computer controlling the exercise machine. Among other things, these grip elements allow the user to activate the resisting load once he is in position and ready for an exercise (e.g. lying on a bench holding a barbell to perform the common exercise called "chest press") without the need of conventional weight resting structures. Moreover, in case of emergency, the user can shut down the resisting load without external aid. Those grip elements are effective only if the load sources are electronically controlled (e.g. electric motors, pneumatic actuators) and may be installed in any type of exercise machines having an electronically controlled load source.

Still another object of the invention is a safety system that ensures full stability of the machine frame, allowing the realization of a compact (with small frame) and light exercise machine, without the need to constrain the machine to the ground, to walls or to fixed objects.

Finally, another object of the present invention is to overcome some drawbacks of the prior art by combining some or all the means described above to realize safe, light, compact, transportable and storable exercising machines for performing a wide range of weight or functional or rehabilitation training exercises.

The Applicant has devised, tested and embodied the present invention to overcome the shortcomings of the state of the art and to obtain these and other purposes and advantages.

Other limitations and disadvantages of conventional solutions and technologies will be clear to a person of skill after reading the remaining part of the present description with reference to the drawings and the description of the embodiments that follow, although it is clear that the description of the state of the art connected to the present description must not be considered an admission that what is described here is already known from the state of the prior art.

SUMMARY OF THE INVENTION

The present invention is set forth and characterized in the independent claim, while the dependent claims describe other characteristics of the invention or variants to the main inventive idea.

According to the present invention a machine for gymnastic exercises comprises:

- a sliding rail,
- a carriage installed in a sliding manner on the sliding rail,
- a first pulley and a second pulley installed on the carriage and rotatable in an idle manner around respective axes of rotation,
- a gripping element,
- cable traction means comprising a first cable branch and a second cable branch provided with respective and separate connection ends attached to the gripping element,
- the first cable branch and the second cable branch wind at least partly around the first pulley and respectively the second pulley to define first return segments comprised between the gripping element and respectively the first pulley and the second pulley, and second return segments that extend one on a first side and the other on a second side, opposite the first side, of the carriage and substantially parallel to the sliding rail, wherein load sources are connected to the second return segments or the first cable branch and/or the second cable branch are made of elastomer material that constitutes load sources, the load sources being configured to generate a resisting force with a constant intensity and direction perceived on the gripping element during a traction exerted by a user on the gripping element.

According to an alternative embodiment of the present invention a machine for gymnastic exercises comprises:

- a gripping element,
- a first motor configured to generate a first load source,
- a second motor configured to generate a second load source,
- cable traction means comprising a first cable branch and a second cable branch provided with respective and separate connection ends attached to the gripping element, and with respective and separate traction ends, opposite the connection ends and connected to the first motor and respectively to the second motor in order to receive the first load source and respectively the second load source,
- a control and command unit connected to the first motor and the second motor and configured to regulate the first load source and the second load source and generate a resisting force with a constant intensity and direction perceived on the gripping element during a traction exerted by a user on the gripping element.

Here and hereafter in the description and the claims, the word cable includes a cable as such and also components like a cable, such as belts and chains.

While DOF used hereinafter stands for "degree of freedom", in general, for each grip element, the resisting load perceived by the user holding the grip element itself, can have:

- one DOF where the device can control only the value of the resisting load, but not the direction, which stays uncontrolled and depends on user's position and machine configuration. One DOF requires only one resisting load source. This is the configuration in conventional exercise machines, without the vectoring system here invented.
- two DOFs where the device can control the value of the resisting load and the direction in a working surface. At least two independent resisting load sources are required for each grip element.
- three DOFs: the device can control the value of the resisting load and the direction in a working volume. At least three independent resisting load sources are required for each grip element.

Two and three DOFs vectoring systems can be under actuated, namely they can have a number of independent load sources lower than the number required for a full control. In these cases it is possible to keep constant the resisting force direction (independently from user position), but the direction cannot be changed and depends on the machine configuration. Only two DOFs vectoring systems will be claimed in this application. Three DOFs vectoring systems require carriages able to move in a plane instead of moving along a path and more complex cable arrangements but may be obtained through combination of the basic vectoring systems here described.

Different embodiments of the vectoring system, some of which are described in detail further in this application, allow different levels of force vectoring depending on the number of load sources, cable traction means path and mechanisms involved for each grip element.

The preferred resisting load source for this invention are electric motors, and more preferred are some non-conventional, in such machines, compact electric motors that allow installation in a thin housing, helping in the realization of a compact exercise machine. Such motors require or may need other conventional components to properly operate, such as a power source, a motor controller, additional sensors to measure motor speed or actual resisting load provided. The motors are linked to a winding spool where the cable traction means is wound and un-wound according to user exercise movements, said motors keeping the desired tension on the cable allowing dynamic control of resisting force magnitude (and direction if used with a vectoring system), these motors being suitable for acting at the same time as load sources and sensors that monitor user movements and recognize specific user gestures made for controlling the machine. This capability is obtained thanks to the substantial proportionality between the motor voltage and the motor speed, or with specific sensors (e.g. encoders) able to measure motor speed which is related to user movements.

Preferred electric motor types are the known "pancake" motors with a printed armature allowing extremely flat geometry. They can be directly coupled to the spool or with different transmission systems that can increase the torque and keep a flat geometry of the system.

Another preferred motor type is the hub motor (like those used in e-bikes) or external rotor motor whose rotating case allows the cables to be directly wound around said motor case instead of having a separated spool.

Still another preferred motor type is a conventional motor (AC or DC) coupled with a planetary gearhead to increase the torque. The spool is directly coupled on the geared shaft, resulting in a long, slender and coaxial design, allowing installation in a thin housing.

Preferred embodiment for at least one of the grip elements comprises interface devices that allow said grip element to act as input devices and user interface to the machine by means of visual, acoustic or tactile feedback for the exercise or machine setup and control means (of conventional kind, like at least one button, one switch, . . . ) to activate, deactivate or change the resisting load, even during an exercise. Such interface devices in the prior art are located on a machine frame. This embodiment of grip elements is effective only if the resisting load is electronically controllable (such as pneumatic or electric actuators).

This capability can be combined with the capability of the preferred load source type, the electric motor, to act as input device and recognize user gestures.

In particular and for example, when a user pushes a certain button, for example of a set of buttons incorporated in each grip element, the machine switches to "set-up mode", then the user raises or lowers the grip element (pulling or releasing the cable and consequently forcing the electric motor to rotate accordingly to user motion) respectively to increase or to lower the resisting load. Other user's gestures can be implemented, for example to change the vectoring system angle (if a vectoring system is implemented). More specifically, the at least one button (or equivalent means) has at least one of the following functions: turn on, turn off, change the resisting load, change the operation mode. Feedbacks to the user may be embodied through vibrating devices or visual indicators (e.g. screens or led) or speakers. Sensors to improve user gestures reading may be embodied through Inertial Measurement Units (accelerometers, gyroscopes, etc.). All functions provided from the grip element may be combined and have the purpose to improve usability and safety of the device.

ADVANTAGES OF THE INVENTION

First of all among the several advantages of the invention, the resisting force direction perceived at the grip elements is controllable by the user and is automatically held at the specified value without additional actuators other than the resisting load sources. Optionally, the direction accuracy may be improved by dedicated sensors. Moreover the load vectoring system acts dynamically during an exercise allowing the implementation of a variable training curve in function of other parameters. Moreover, the vectoring system acts also as an automatic adjustment system that allows the user to quickly change between different kinds of exercises or assume different positions within the working area without the need to manually change the configuration of the machine. Furthermore, the load vectoring system may be used to set and hold the carriage at a specific position without the need to do it manually, allowing the user to perform exercises as in conventional cable machines having a fixed or selectable cable exit point.

The preferred resisting load source for this invention, being a non-conventional (for such type of exercise machine) compact electric motor linked to a winding drum where the cable is wound and un-wound during an exercise, allows dynamic control of resisting load magnitude and direction, ensures lightness and compactness of the machine and increases safety thanks to the capability of instantaneously turning off the load in case of emergency. This is associated with the capability of the electric motor to act also as a sensor suitable for measuring user movements during exercises and in particular recognizing specific user gestures made for controlling the machine behavior.

The preferred embodiment for at least one grip element, acting as an input device and user interface to the machine, through conventional means that in prior art were located on machine frame, enhances ergonomics and ease of use, and moreover increases safety of the device, allowing the user to activate the resisting load when ready and deactivating it at any time.

Said capabilities may be associated with another preferred security feature of the present invention that prevents or warns the user about machine instability or overturn risks that may arise in light machines not fixed to ground or walls.

One embodiment for the machine has the shape of a thin platform where the user positions itself to perform the exercise. All the mechanisms are hidden in said platform, improving the device safety by preventing the user from being harmed by machine moving parts. Being the platform lightweight and freely resting on the ground, it may be moved at will and stored when not in use.

Finally, the invention permits a modular approach, namely to use a combination of basic mechanisms abovementioned to build more complex exercise machines and allow the addition of conventional or special equipment including benches, racks and pulley systems to invert the load direction.

These and other aspects, characteristics and advantages of the present disclosure will be better understood with reference to the following description, drawings and attached claims. The drawings, which are integrated and form part of the present description, show some forms of embodiment of the present invention, and together with the description, are intended to describe the principles of the disclosure.

The various aspects and characteristics described in the present description can be applied individually where possible. These individual aspects, for example aspects and characteristics described in the attached dependent claims, can be the object of divisional applications.

It is understood that any aspect or characteristic that is discovered, during the patenting process, to be already known, shall not be claimed and shall be the object of a disclaimer.

BRIEF DESCRIPTION OF THE DRAWINGS

These and other characteristics of the present invention will become apparent from the following description of a preferential form of embodiment, given as a non-restrictive example with reference to the attached drawings wherein.

Figure 1:
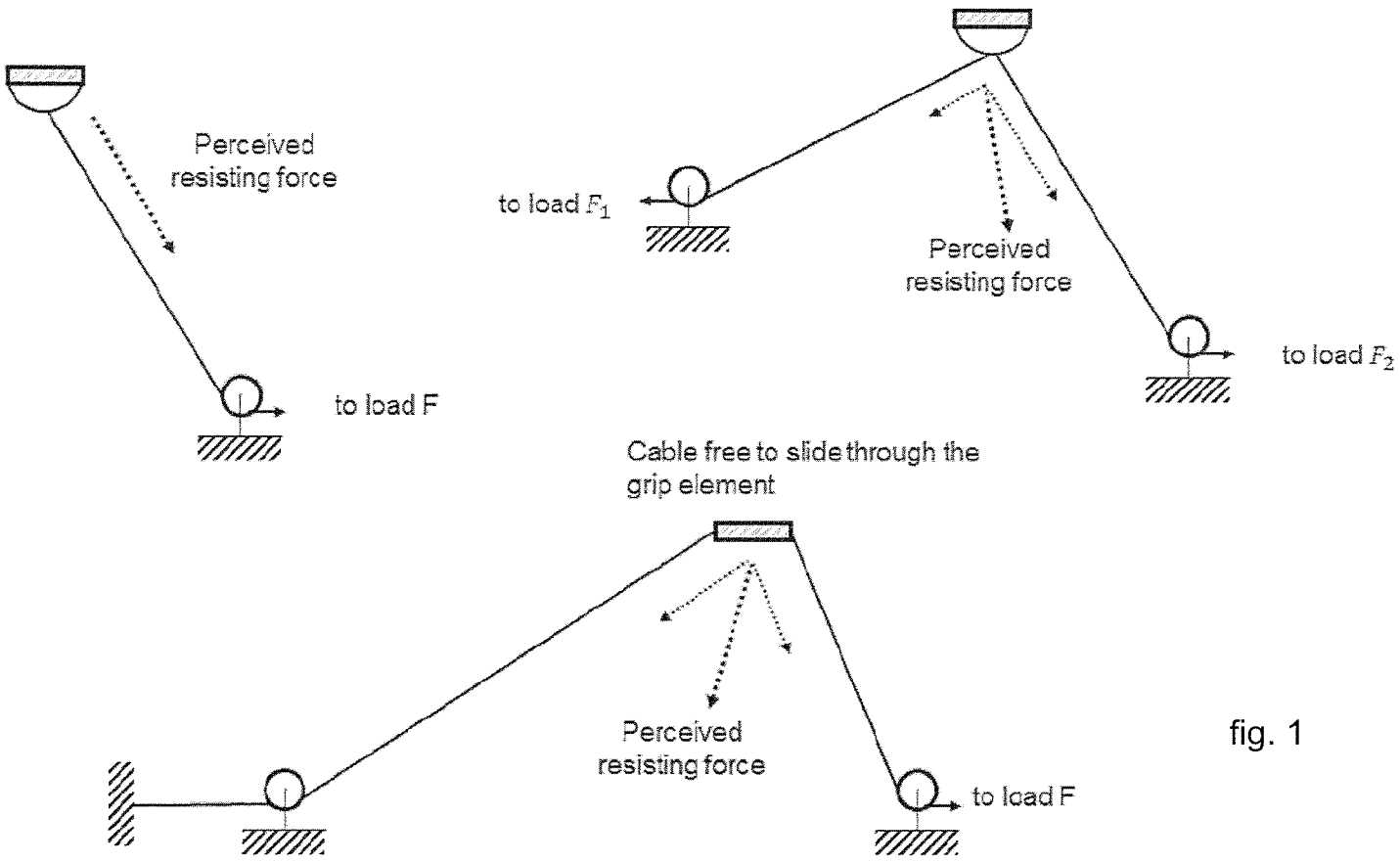
FIG. 1 shows some diagrams of the functioning and distribution of the loads in known exercise machines.

To facilitate comprehension, the same reference numbers have been used, where possible, to identify identical common elements in the drawings. It is understood that elements and characteristics of one form of embodiment can conveniently be incorporated into other forms of embodiment without further clarifications.

DETAILED DESCRIPTION OF SOME EMBODIMENTS

We shall now refer in detail to the various embodiments of the present invention, of which one or more examples are shown in the attached drawings. Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

Before describing these embodiments, we must also clarify that the present description is not limited in its application to details of the construction and disposition of the components as described in the following description using the attached drawings. The present description can provide other embodiments and can be obtained or executed in various other ways.

Figure 2:
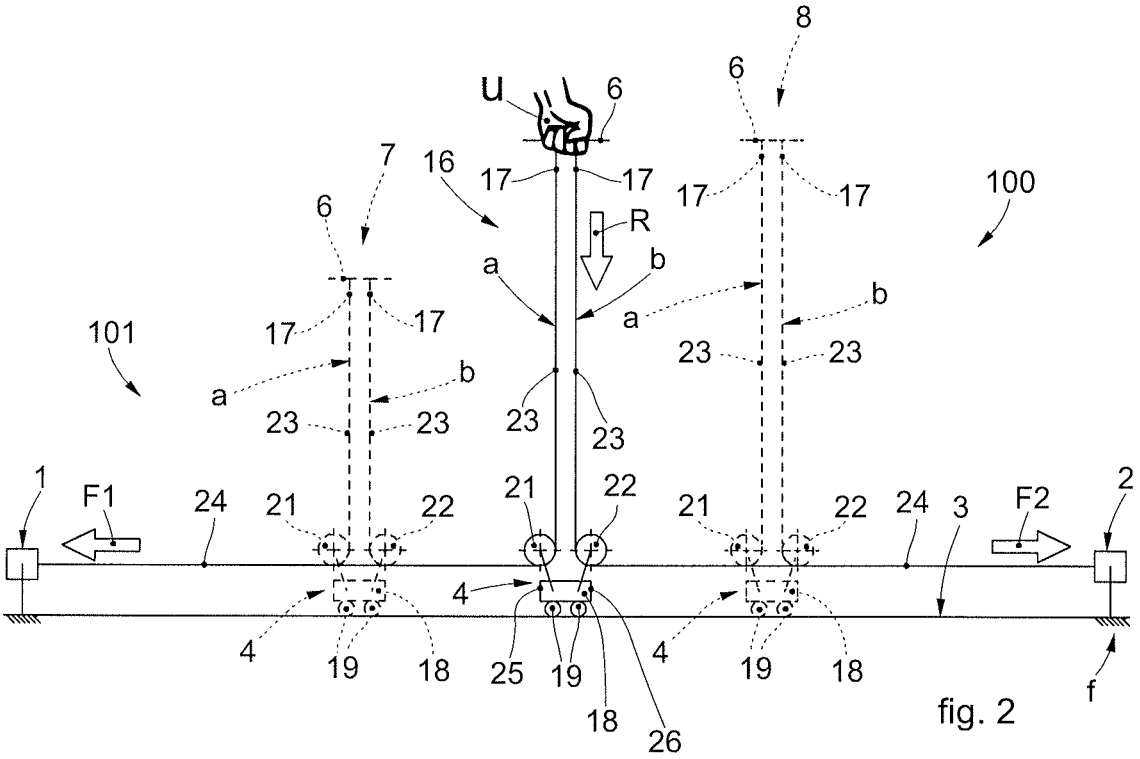
FIG. 2 is a schematic illustration of an exercise machine in accordance with one possible embodiment.

The invention will be described in detail with examples of embodiments and with reference to a two DOFs configuration with full control (two load sources) and under actuated (one load source) and with the help of the design in which FIG. 2 shows an embodiment of an exercise machine 100 for two DOFs full Vectoring system: two resisting load sources, respectively a first load source 1 and a second load source 2 act, directly or through a path of sheaves (not shown for simplicity), on a cable traction means 16.

The first load source 1 and the second load source 2 are configured to generate respectively a first force F1 and a second force F2.

According to some embodiments, the exercise machine 100 can comprise a machine frame "f" configured to support at least part of the components of the exercise machine 100.

The machine frame f can be defined by connection brackets in order, for example, to allow their connection to a wall or a floor, or by an actual framework, attachable either to a wall or floor.

The cable traction mean 16 can be made in a single body or can comprise two or more cables reciprocally connected to each other.

According to possible solutions, the cable traction mean 16 comprises a first cable branch "a" and a second cable branch "b" provided with respective and separate connection ends 17 attached to a gripping element 6.

According to possible embodiments of the present invention, it can be provided that the first cable branch a and the second cable branch b are made in a single body, for example connected in a single body in correspondence with the connection ends 17, and/or their opposite ends.

The exercise machine 100 comprises at least one carriage 4 installed in a sliding manner, that is free to slide, on a sliding rail 3.

According to a possible operating condition, not part of the invention, the carriage 4 can be selectively clamped in a desired position, either manually or with additional actuators.

The sliding rail 3 can be rectilinear or have a conformation like an arc of a circle, or circular.

The sliding rail 3 can be defined by a section bar, hollow internally or suitably shaped to receive the carriage 4 inside it in a sliding manner. Merely by way of example the hollow section bar can be C-shaped, inside which the carriage 4 is located and from whose longitudinal aperture the cable traction mean 16 exits.

The sliding rail 3 can be coupled with the machine frame f.

The carriage 4 can comprise a support body 18 and sliding elements 19, for example one or more wheels, or balls, suitable to promote the sliding of the carriage 4 along the sliding rail 3.

According to a possible embodiment of the present invention, the exercise machine 100 comprises a first pulley 21 and a second pulley 22 installed on the carriage 4 and rotatable in an idle manner around respective axes of rotation.

According to possible solutions, the first cable branch a and the second cable branch b wind at least partly round the first pulley 21 and respectively the second pulley 22 to define first return segments 23 comprised between said gripping element 6 and respectively said first pulley 21 and second pulley 22, and second return segments 24 that extend one on a first side 25 and the other on a second side 26, opposite the first side 25, of the carriage 4 and substantially parallel to the sliding rail 3.

Thanks to the particular positioning configuration of the second return segments 24, one on one side and the other on the other side of the carriage 4, it is possible to ensure a translation of the carriage 4 along the sliding rail 3 as soon as a user U induces a stress on the gripping element 6, or a variation of its position in the space.

The possibility of translation of the carriage 4 along the sliding rail 3 ensures that the user U always perceives the same orientation of a resisting force R that is generated as a result of the sum of the first force F1 and the second force F2 exerted by the first load source 1 and the second load source 2 respectively.

According to a possible embodiment, the first load sources 1 and the second load sources 2 can comprise one or more blocks of weights.

According to a possible embodiment, the first load sources 1 and the second load sources 2 can comprise one or more elastic elements configured to elastically oppose the force exerted by a user. According to possible embodiments, the elastic elements can be chosen from a group comprising at least one of either a spring, a resistance element, a pneumatic piston, or similar or comparable components.

According to a possible variant embodiment, at least part of the first cable branch a and the second cable branch b are made of elastomer material and themselves constitute a load source.

According to other embodiments, the first load source 1 and the second load source 2, also part of the vectoring system and in the number required for the specific vectoring system embodiment, are electric motors suitable for receiving user's input to control the resisting loads, in magnitude and direction, and for reading user gestures made for controlling the machine behavior.

In particular, the first load sources 1 and the second load sources 2 can each comprise at least a motor suitable to generate in the first cable branch a and in the second cable branch b a force resistant to the force exerted by the user.

According to possible embodiments of the present invention, the motor can comprise a rotary motor or a linear motor.

It is quite evident that the first load sources 1 and the second load sources 2 can also be obtained from a combination of said embodiments.

Experiments and computer simulations showed that, if the load sources 1, 2 (e.g. two electric motors, although the mechanism is independent from the load source type) exert the same amount of forces F1=F2=F, the carriage 4 tends to position right under the grip element 6, as visible in position 8 of FIG. 2. Vertical movements of the grip element, as shown in position 7 in FIG. 2, do not affect the horizontal position of the carriage 4. This allows the user U to perform complex trajectories on the grip element 6 always perceiving a resisting force R that according to the embodiment of FIG. 2 is equal to 2×F pointing downwards, as occurs in conventional weights subject to earth's gravity.

Figure 3:
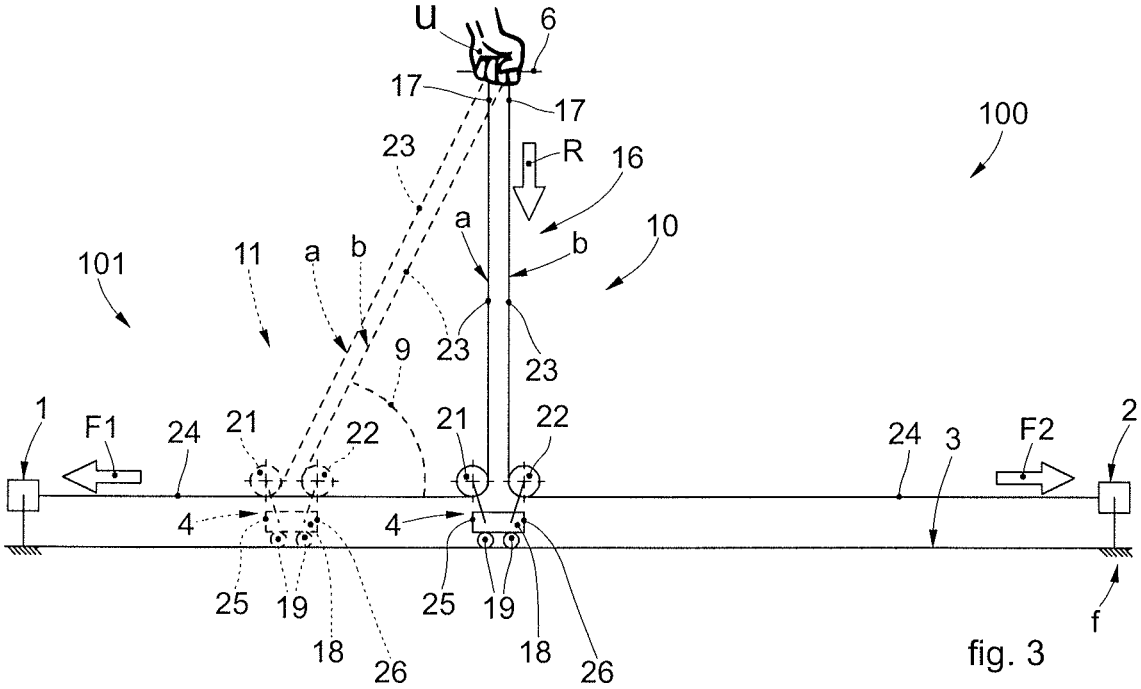
FIG. 3 is a schematic illustration of the machine in FIG. 2 in a different condition of use.
Figure 4:
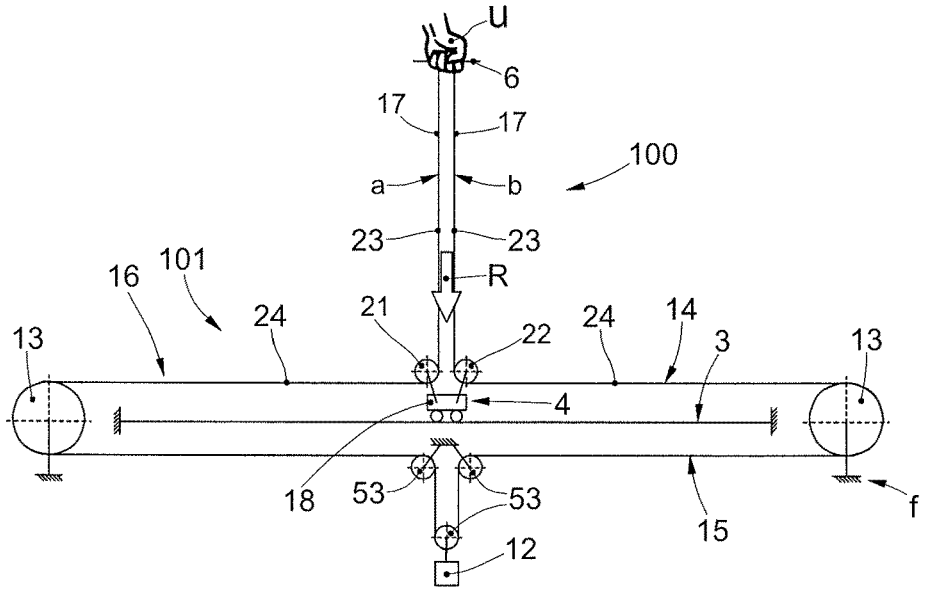
FIG. 4 is a variant embodiment of FIG. 2.

FIG. 3 shows that if the load sources 1, 2 exert different forces, for example F1 greater than F2, the carriage 4 moves from position 10 to position 11, so that the angle of the cables, with respect to the horizontal direction, forms an angle 9 according substantially to the following mathematical relation: angle=arcos[(F1−F2)/(F1+F2)]. In simple words, the angle 9 depends substantially only on the forces F1 and F2, which can be modulated to achieve the desired behavior. In such condition the user U can freely move the grip element 6 perceiving a resisting force R equal to F1+F2 oriented with an angle 9 with respect to the horizontal direction. It must be noticed that if F1 and F2 are equal, the mathematical relation results in an angle of 90°, giving the condition described in FIG. 2.

According to a possible solution, the sliding rail 3, the carriage 4, the first pulley 21, the second pulley 22, the gripping element 6 and the cable traction mean 16 as described above can define, together, a module for exercises 101.

According to possible embodiments, a single module for exercises 101 can itself define the exercise machine 100.

FIGS. 2-12 show solutions relating to a module for exercises 101 as described above.

According to the solution shown in FIG. 3, the first cable branch a and the second cable branch b are made in a single body to define a single cable traction mean 16.

According to this solution, the exercise machine 100 is provided with return members 13 disposed distanced from each other and located, for example, in correspondence with the ends of the sliding rail 3.

The cable traction mean 16 winds around the first pulley 21 and the second pulley 22 associated with the carriage 4 and subsequently around the return members 13.

The cable traction mean 16 therefore has a first return segment 14, located above in FIG. 3, and defined by said first cable branch a and second cable branch b and at least a second return segment 15, in FIG. 3 located below and opposite the first return segment 14.

Load sources 12 are associated with the second return segment 15 of the cable traction mean 16 and are provided to exert a resisting force R on the cable traction mean 16 that is perceived by the user U on the gripping element 6.

The load sources 12 can comprise one or more weights. According to this solution, the resisting force R perceived by the user U is always vertical, or orthogonal to the longitudinal development of the sliding rail 3.

According to possible solutions, return elements 53 are associated with the second return segment 15 and configured to maintain the load sources 12 in a predefined position. The return elements 53 can be installed on the machine frame f.

Figure 5:
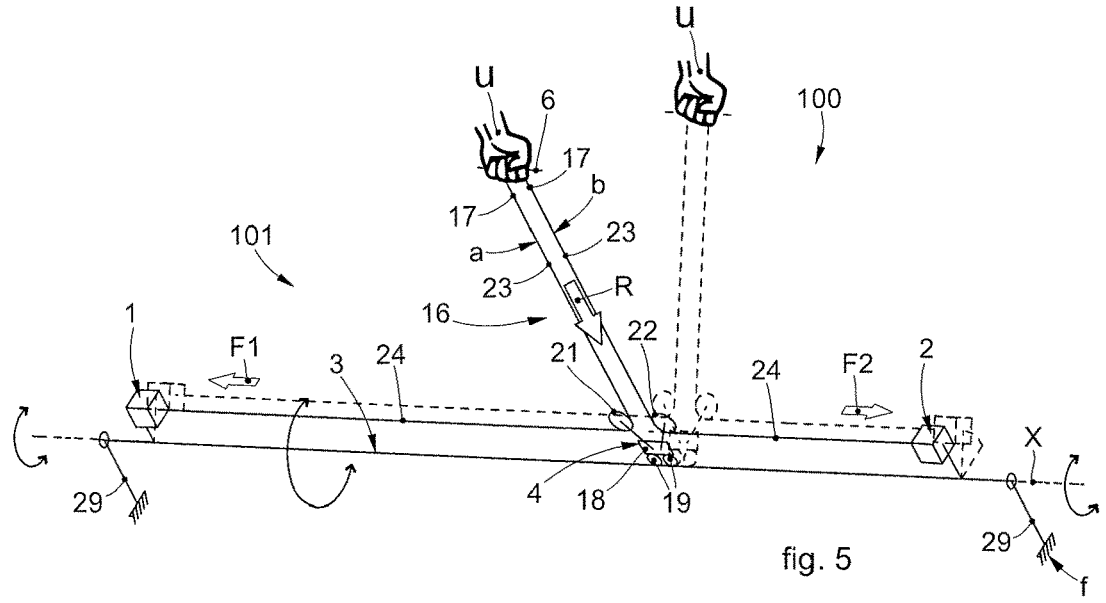
FIG. 5 shows another variant embodiment of FIG. 2.

According to the solution shown in FIG. 5 it is provided that the sliding rail 3 is installed, with respect to the machine frame f, rotatable around an axis of rotation X parallel to the longitudinal extension of the sliding rail 3.

This configuration allows to supply greater versatility of use to the exercise machine 100.

According to this variant embodiment, the first load source 1 and the second load source 2 can be moved in rotation solidly with the rotation of the sliding rail 3.

Figure 6:
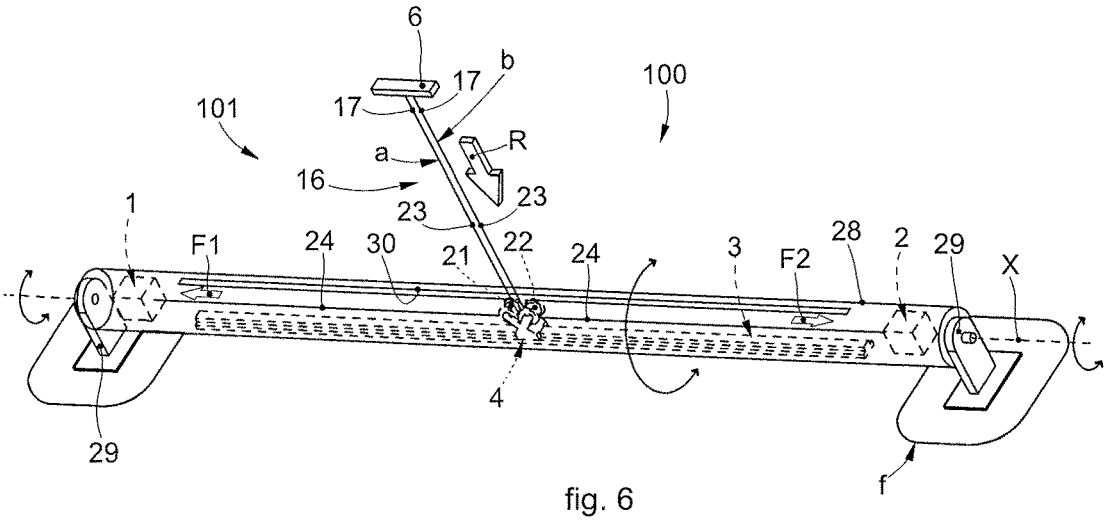
FIG. 6 is a possible solution of the schematic illustration in FIG. 3.

In FIG. 6 a possible solution is shown in which the sliding rail 3 is installed on a support element 28.

The support element 28 is supported at its two ends by pivoting elements 29 attached to a fixed structure. The pivoting elements 29 are configured to allow a rotation of the support element 28 around the axis of rotation X.

According to a possible variant embodiment, the pivoting elements 29 can themselves define the machine frame f, or they can be an integrating part of it.

According to the solution shown in FIG. 6, the support element 28 can have a box-like or tubular shape, that is, it is provided with at least a cavity in which the sliding rail 3 is fixed, and the carriage 4 is at least partly contained therein.

The support element 28 can comprise a slit 30 that connects the cavity of the support element 28 with the outside, and that extends substantially parallel to the sliding rail 3.

The first load source 1 and the second load source 2 are installed solidly with the support element 28, in this case in the cavity of the latter.

Figure 7:
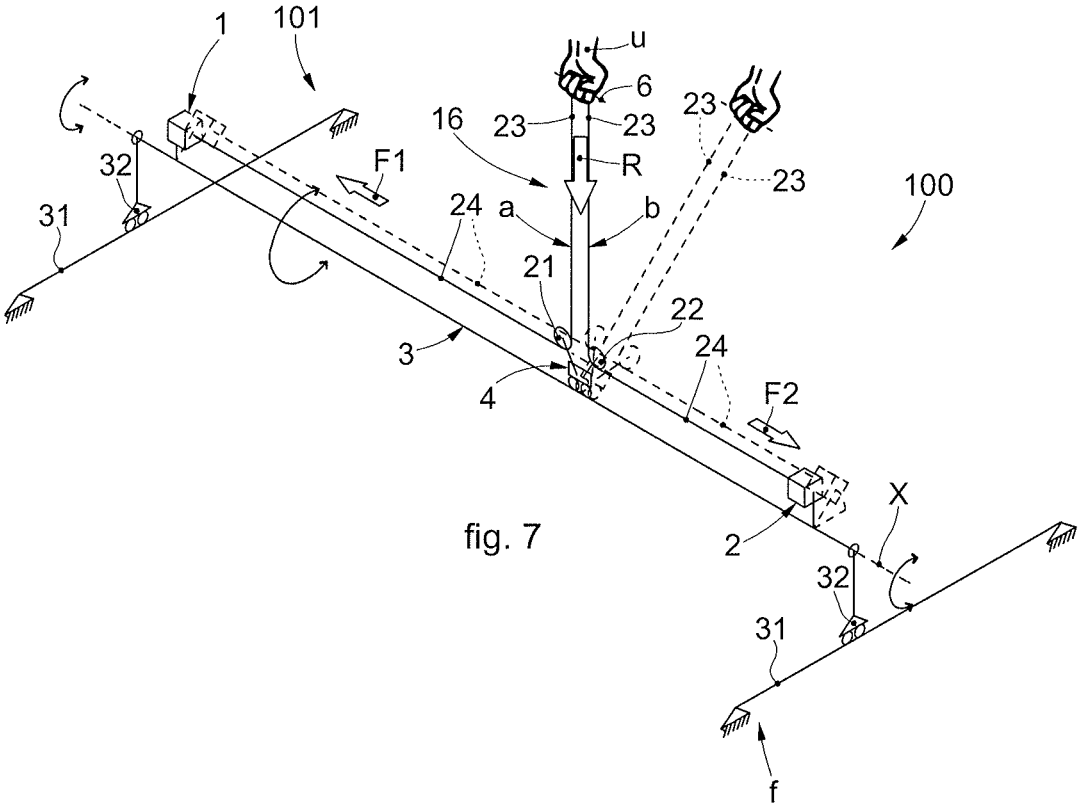
FIGS. 7 and 8 show possible variant embodiments of FIG. 5.

According to another embodiment, shown for example in FIG. 7, it can be provided that the sliding rail 3 is installed on transverse guides 31 positioned transversely, in this case, orthogonal to the oblong development of the sliding rail 3.

According to this embodiment, the machine frame f comprises the transverse guides 31 installed either on a fixed structure or on other parts of the machine frame f.

The sliding rail 3 is associated directly or indirectly, for example by means of the support element 28, to sliding devices 32 installed sliding along the transverse guides 31. The sliding devices 32 can comprise a carriage and wheels and/or balls for the guided sliding of the carriage along the transverse guides.

In this embodiment too, it is possible to provide that the sliding rail 3 is rotatable around the axis of rotation X.

Figure 8:
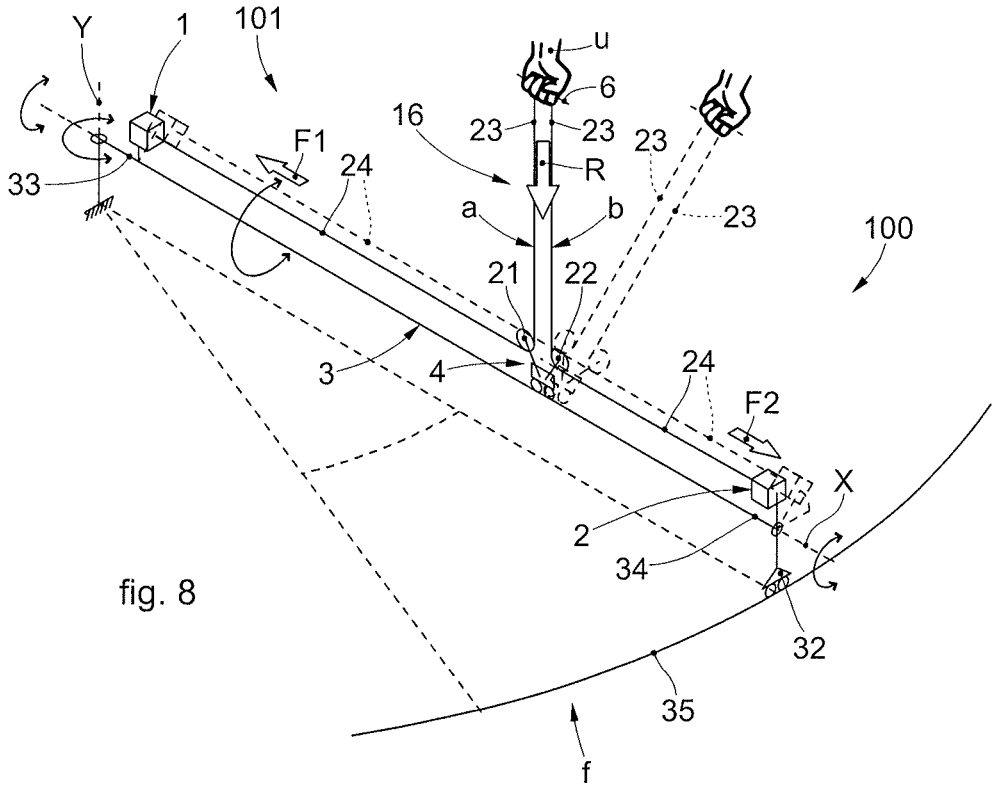

According to another variant embodiment, described for example with reference to FIG. 8, it is possible to provide that the sliding rail 3 is selectively or freely rotatable around a second axis of rotation Y that is orthogonal to the longitudinal development of the sliding rail 3.

According to a possible solution, shown in FIG. 8, the second axis of rotation Y is positioned in correspondence with a first end 33 of the sliding rail 3.

A second end 34 of the sliding rail 3, opposite the first end 33, is free to slide along an arc of a circle trajectory 35. According to this solution, the second end 34 can be provided with sliding devices 32 configured to support and allow the sliding of the sliding rail 3 with respect to a support plane.

According to possible embodiments of the invention, a curved guide can be associated with the arc of a circle trajectory 35, provided to control and guide the movement of the second end 34. The curved guide can be associated with the machine frame f.

According to possible embodiments, described with reference to FIG. 8, the sliding rail 3 as well as being rotatable around the second axis of rotation Y is also rotatable around the axis of rotation X in a substantially similar manner to that described with reference to FIGS. 5-7.

According to another embodiment, described with reference to FIG. 9, it can be provided that the first load source 1 and the second load source 2 each comprise respectively a first motor 36 and a second motor 37 suitable to generate in the first cable branch a and the second cable branch b a force resistant to the force exerted by the user U.

According to a preferred solution, the first motor 36 and the second motor 37 are electric motors, for example pancake motors.

Merely by way of example, it can be provided that the first motor 36 and the second motor 37 are each provided with a drum 44 selectively rotatable around its own axis of rotation and on which the first cable branch a, or the second cable branch b wind.

The first motor 36 and the second motor 37 are provided with respective control devices 38 provided to control the force that the first motor 36 and the second motor 37 are able to oppose against the movement of the first cable branch a and the second cable branch b.

According to possible solutions, the control devices 38 can be configured to detect respectively the first force F1 and the second force F2 exerted respectively in the first cable branch a and in the second cable branch b. Merely by way of example, the control devices 38 can comprise a force sensor, a load cell, an extensimeter, or similar or comparable sensors.

According to possible variant embodiments the control devices 38 can be configured to detect at least an electric functioning parameter of the first motor 36 and the second motor 37, such as the electric current absorbed.

The control devices 38 can be connected to a control and command unit 39 configured to coordinate the drive of the first motor 36 and the second motor 37 and to determine the entity of the first force F1 and the second force F2 that is imparted in the first cable branch a and the second cable branch b.

Figure 9:
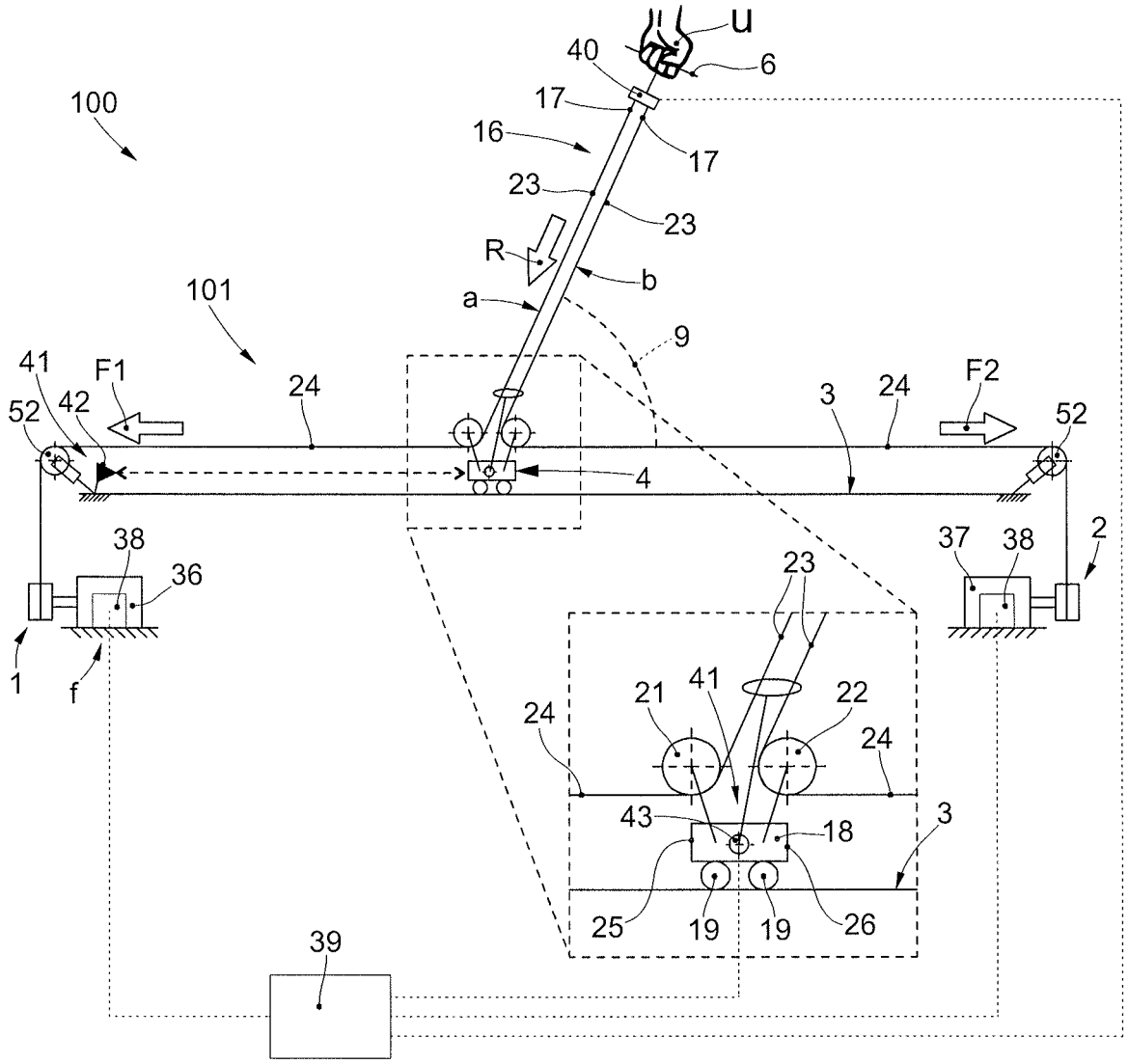
FIG. 9 shows another embodiment of the present invention.

In particular, by suitably coordinating the entity of the forces F1 and F2 it is possible to determine a predefined angulation of the first return segment 23 with respect to the second return segment 24 to make the user U perceive a predefined angulation of the resisting force R, shown in FIG. 9 by the angle 9.

A difference between the first force F1 and the second force F2 determines a movement of the carriage 4 in one direction or the other along the sliding rail 3, and therefore a different inclination of the first return segments 23.

According to a possible solution, the exercise machine 100 can comprise an interface device 40 connected to the control and command unit 39 and with which the user U can interact to command specific execution modes of the exercises. The commands supplied by the interface device 40 are used to determine the drive modes of the first motor 36 and the second motor 37.

In particular, it can be provided that the control and command unit 39 is provided with memorization devices in which predefined functioning programs of the exercise machine 100 are memorized. By means of the interface device 40 the user U selects one or the other of the functioning programs determining different drive modes of the first motor 36 and the second motor 37.

According to possible formulations of the present invention, detectors can be associated with the first cable branch a and the second cable branch b, in this specific case said control devices 28, configured to detect determinate stresses and/or movements exerted by the user U on the gripping element 6.

The control and command unit 39 is configured to receive from the load detectors, in this case from the control devices 28, data relating to the respective stresses acting, in order to process the data and identify particular gestures made by the user U. The control and command unit 28 can also be configured to compare these gestures detected with predefined movement patterns memorized for example in the memorization device of the control and command unit 39.

A specific functioning command of the machine can be associated with each predefined movement pattern, that is, suitable to perform a specific exercise, to increase the intensity of the resisting force R, to vary the reciprocal angulation of the resisting force R.

Merely by way of example, detecting the gestures of the user U:

- if an upward or downward movement is detected, an increase or decrease in the resisting force is determined,
- if a horizontal movement in one direction or the other is detected, this generates an adjustment of the inclination of the resisting force R perceived by the user U.

Merely by way of example, the interface device 40 can be provided with at least a button, a screen, a touch screen, with which the user U can define for example the entity and/or the direction of the forces exerted by the first motor 36 and by the second motor 37.

The interface device 40 can be associated with the gripping element 6.

According to possible solutions a movement sensor, not shown, can be associated with the gripping element 6, and is configured to detect the movements of the gripping element 6 imparted by the user U.

Merely by way of example, it can be provided that the movement sensor is used to detect the gestures and command the functioning of the machine 100 in a substantially analogous way to that described with reference to the control devices 38.

Again according to possible variant embodiments, not shown, the control and command unit 39 can be provided with devices to transmit information, for example data detected during the use of the machine 100, which are configured to transmit, remotely for example, by means of communication protocols to a remote device, such as a Smartphone, Smart TV, virtual reality viewer, gaming console. The data detected can be interpreted and combined by an application installed in the remote device, with the possibility of sharing the data with other users.

According to another solution, the exercise machine 100 can be provided with detection devices 41 configured to detect at least one of either the position of the carriage 4 along the sliding rail 3 and the angulation of the first return segments 23 with respect to the second return segments 24.

According to a possible solution, the detection devices 41 can comprise at least a first sensor 42 associated with the machine frame f, for example with the sliding rail 3 (in the case shown in FIG. 9), and/or the carriage 4. The first sensor 42 is configured to detect the position of the carriage 4 on the sliding rail 3.

According to another solution, the detection devices 41 comprise a second sensor 43 configured to detect the angulation of the first return segments 23, for example with respect to the respective second return segments 24. Merely by way of example, the second sensor 43 can be installed on the carriage 4.

The first sensor 42 and the second sensor 43, or at least one of them, can comprise at least one of either a photocell, a laser sensor, an inductive sensor, a capacitive sensor.

The control and command unit 39, detecting at least one of either the positioning data of the carriage 4, or the angulation of the first return segments 23, is able to instantly define the drive mode of the first motor 36 and of the second motor 37 and therefore determine the intensity and direction of the resisting force R acting on the gripping element 6 and therefore perceived by the user U.

According to possible solutions the control and command unit 39 is configured to control the torques supplied by the first motor 36 and by the second motor 37 and to keep them constant or variable over time according to a predefined profile.

The rotation speed of the motors on the other hand can be free and depends on the movements of the user.

In more complex control logics, where several sensors are involved, torque and speed are controlled using sensor signals as feedback.

Figure 10:
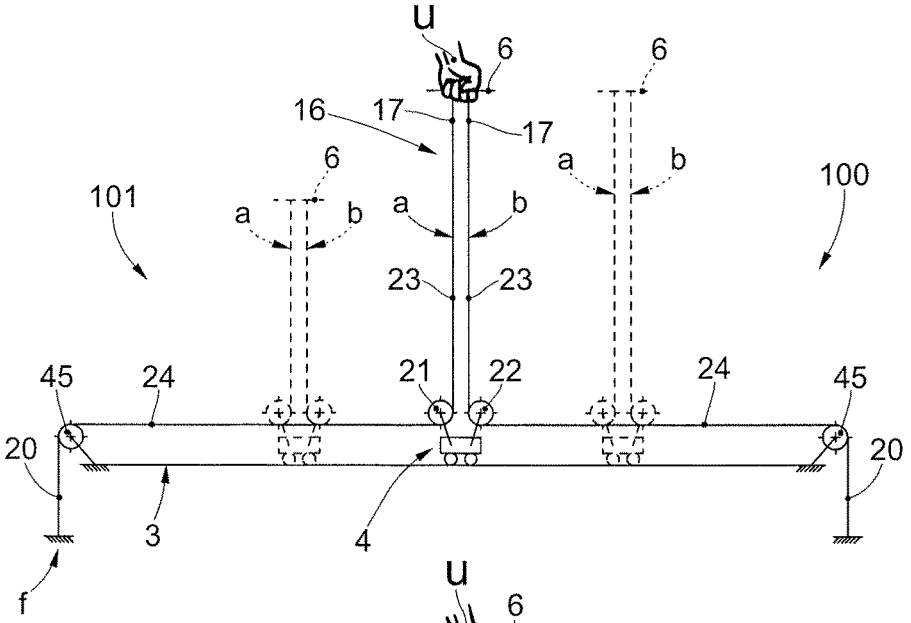
FIGS. 10-12 show possible embodiments in which the cable traction means are made of an elastomer material.
Figure 11:
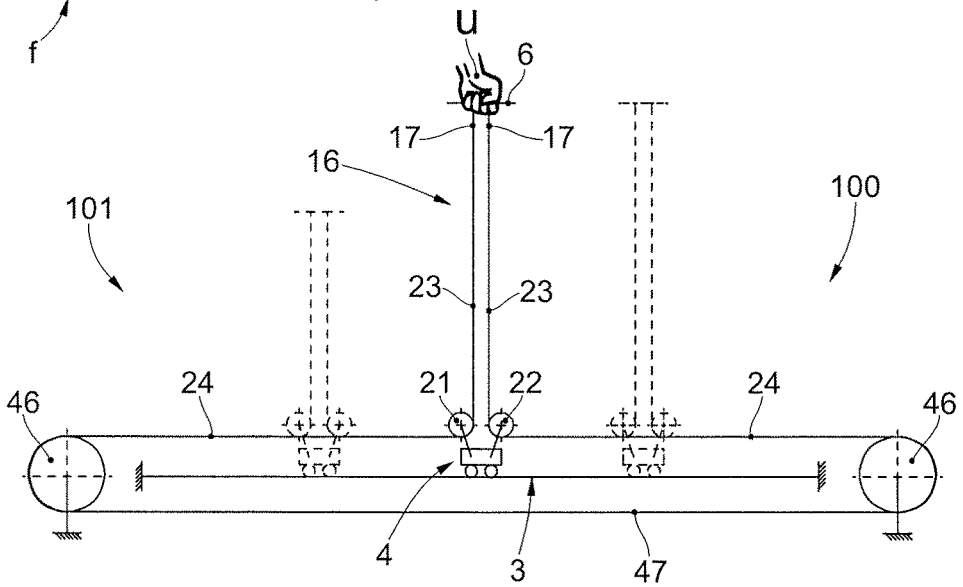
Figure 12:
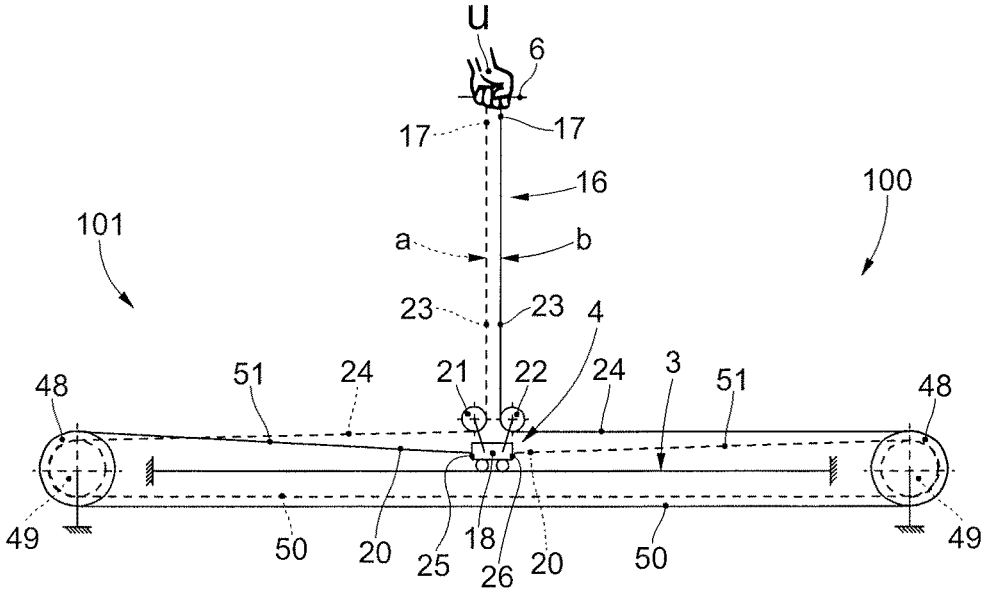

With reference to FIGS. 10-12 we will now describe possible embodiments of the present invention in which the first cable branch a and the second cable branch b are made of an elastomer material and therefore each constitute a respective load source.

According to possible solutions, the first cable branch a can be made of the same elastomer material with which the second cable branch b is made, or it can be made of different materials, for example with different elasticity moduli, in order to define particular directions of perception of the resisting force R by the user U.

The first cable branch a and the second cable branch b can be provided with devices, such as more resistance elements installed on one or the other branch, clamping devices to limit the travel, devices to vary the preload of the resistance elements.

According to the embodiment shown in FIG. 10, the first cable branch a and the second cable branch b are provided with respective attachment ends 20, opposite the connection ends 17, which are attached to the machine frame f, for example in correspondence with respective attachment brackets.

According to a possible solution, the exercise machine 100 can comprise return elements 45, associated with the machine frame f, in this case in correspondence with ends of the sliding rail 3 and configured to maintain at least the second return segments 24 substantially parallel to the longitudinal development of the sliding rail 3.

According to the embodiment shown in FIG. 11, the first cable branch a and the second cable branch b are reciprocally connected with respect to each other in a single body, so that the entire length of the cable traction mean 16 extends between the two connection ends 17 that are attached to the gripping element 6.

According to the solution shown in FIG. 11, the exercise machine 100 can comprise return members 46 around which the cable traction mean 16 winds to define at least said second return segments 24, located parallel to the sliding rail 3, and at least a connection segment 47, located parallel to the second return segments 24.

The return members 46 are positioned attached on the machine frame f.

The presence of the return members 46 allows to make the tension of the cable traction mean 16 uniform along its whole longitudinal extension.

In FIG. 12 another variant embodiment is shown in which the first cable branch a and the second cable branch b each comprise the connection end 17 and attachment end 20.

The attachment ends 20 are both connected to the carriage 4, in this case one on a first side 25 and one on a second side 26 of the carriage 4.

According to the solution shown in FIG. 12, the exercise machine 100 comprises first return members 48 and second return members 49 on which the first cable branch a and the second cable branch b respectively wind.

In particular, it can be provided that the first return members 48 and the second return members 49 each comprise a pair of return wheels.

The return wheels of each pair are located one on one side and the other on the other side of the carriage 4 and the sliding rail 3 is positioned between them.

Both in the first cable branch a and the second cable branch b, as well the first return segments 23 and the second return segments 24, third return segments 50 are also defined that extend between the pair of return wheels of the first return members 48 and of the second return members 49, and fourth return segments 51 that from one of the return wheels of the first return members 48 and the second return members 49 connect, with the attachment ends 20, to the carriage 4.

According to the embodiments shown in FIGS. 10-12, an electronic device can be associated with the gripping element 6, comprising at least one of:

- a sensor, for example a load cell, to detect the resisting force R actually acting on the gripping element 6;
- a sensor, for example an accelerometer and/or gyroscope, to estimate the layout, position and speed of the gripping element 6;
- an electronic control circuit able to process signals by the sensors to calculate exercise parameters (for example power, speed, accumulative training load) and send them to the control and command unit 39 and/or to a remote device, by means of remote communication protocols.

Figure 13:
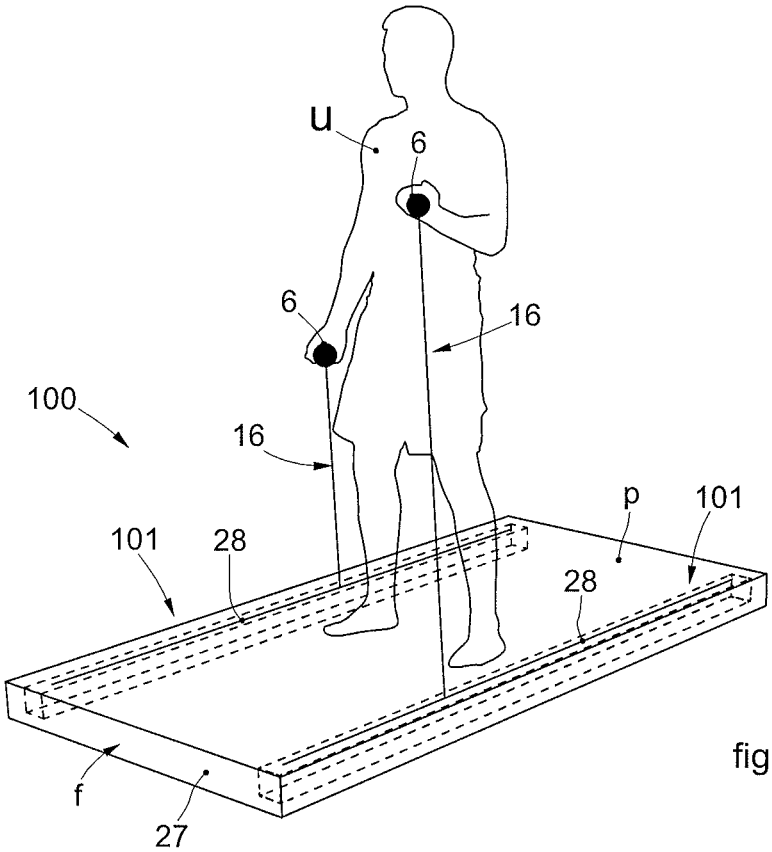
FIGS. 13 and 14 show possible embodiments of the present invention provided with two exercise modules.
Figure 14:
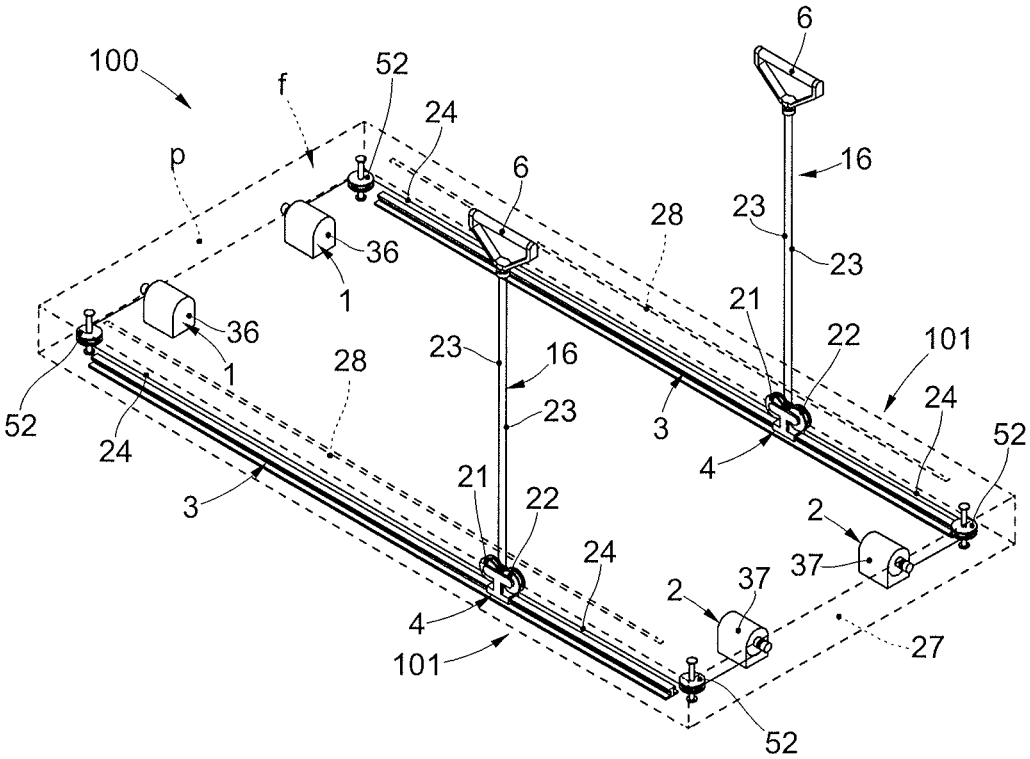

According to possible variant embodiments, shown for example in FIGS. 13 and 14, the exercise machine 100 can comprise a plurality of the exercise modules 101 installed on the machine frame f.

Each exercise module 101 of FIGS. 13 and 14 can have, merely by way of example, a configuration substantially analogous to that described above with reference to embodiments shown in FIGS. 2-12.

According to the particular solution of FIGS. 13 and 14, the exercise machine 100 comprises two exercise modules 101 with the respective sliding rails 3 reciprocally installed distanced from each other, in this case parallel to each other.

According to the embodiment shown in FIGS. 13 and 14, the machine frame f comprises a platform p configured to support the user U.

The platform p can be positioned resting on a support surface, for example the floor.

The sliding rails 3 are solidly associated with the platform p.

The platform p can be defined by a box-like body 27 in which at least the sliding rails 3 and the respective carriages 4 are installed.

The box-like body 27 is also provided with slits 28 through which the cable traction means 16 are made to pass in order to position the respective gripping elements 6 outside the box-like body 27.

The user U can therefore act both on one and the other of the gripping elements 6, or both at the same time, in order to do the exercises.

With reference to FIG. 14, in each exercise module 101 the first load source 1 and the second load source 2 comprise the first motor 36 and the second motor 37 in a manner substantially analogous to that described above with reference to FIG. 9.

In each exercise module 101, return wheels 52 can also be provided, between which the sliding rail 3 is positioned and configured to define the second return segments 24 parallel to the sliding rail 3.

Figure 15:
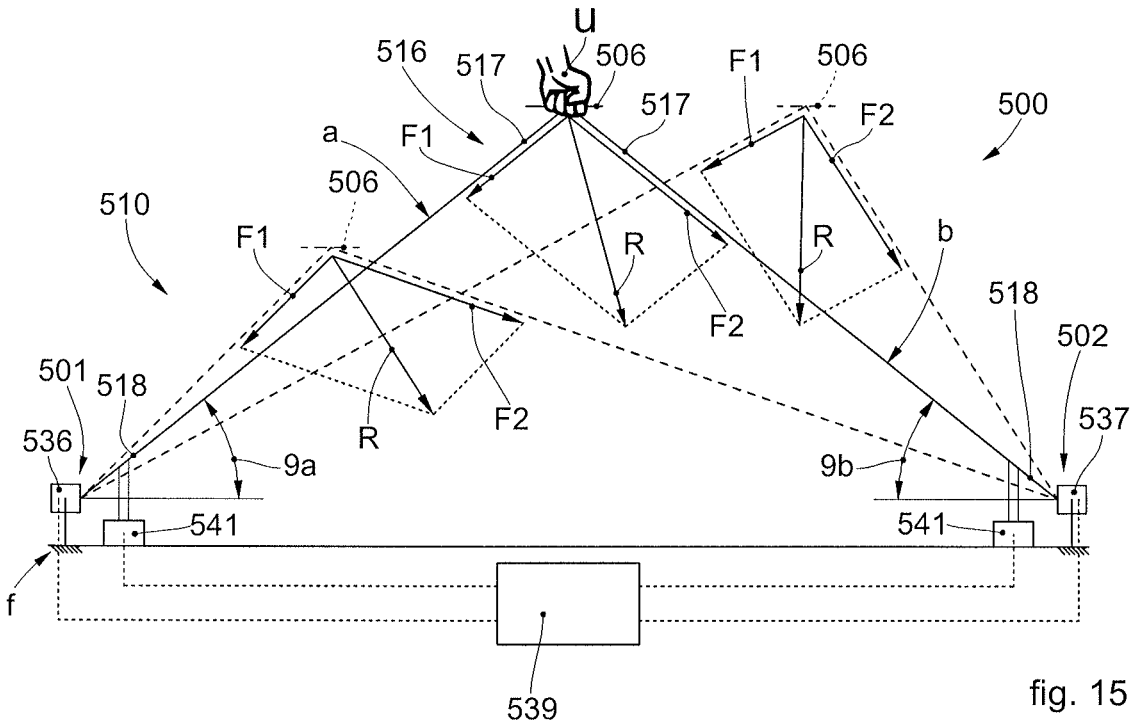
FIGS. 15 and 16 show further alternative embodiments of the present invention.
Figure 16:
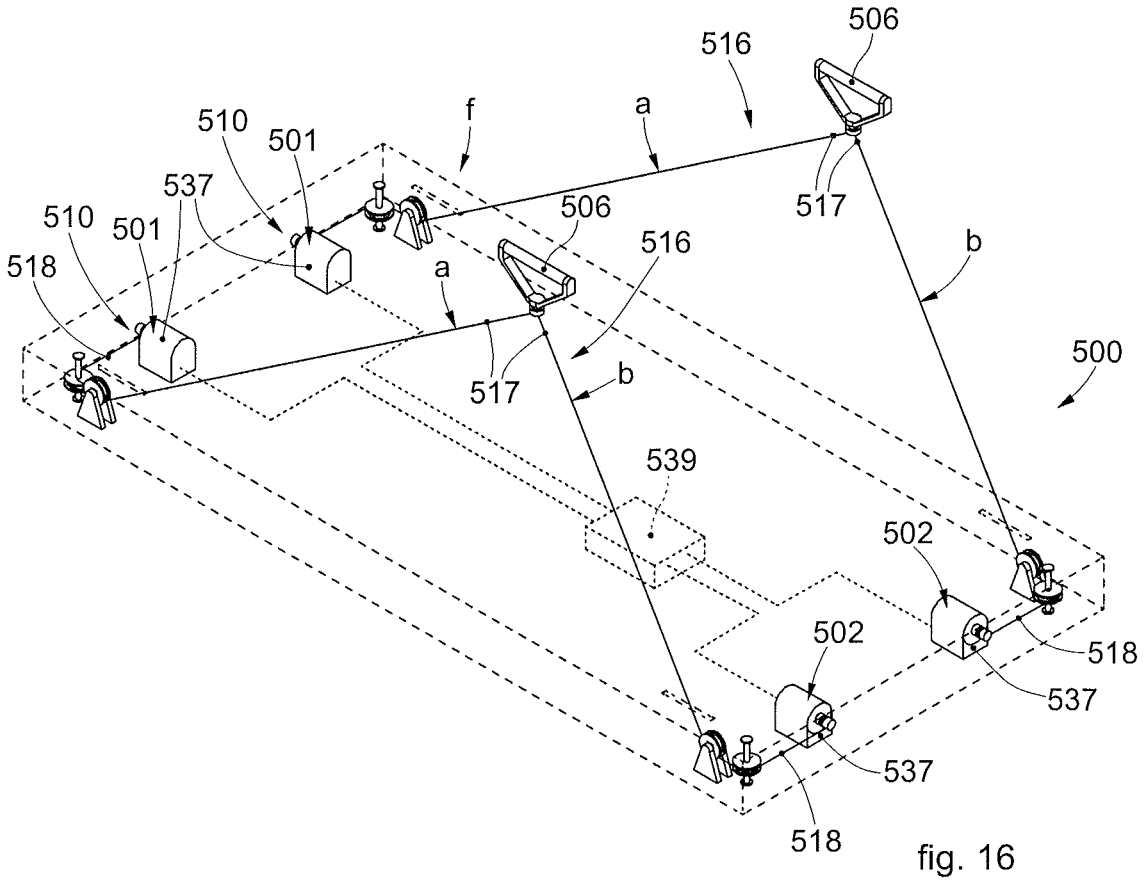

FIGS. 15 and 16 show that in another embodiment for two DOFs full vectoring a similar result is obtained without a carriage, pulleys and guide rail. In such a case electronically controllable load sources 1 and 2, and additional sensors are mandatory to control the direction of the resisting force by modulating the resisting forces F1 and F2 exerted by the load sources 1 and 2, so that at the grip element 6 the user U perceives a resisting force R equal to the vector sum of F1 and F2, acting each along the direction of the respective first branch of cable a, and second branch of cable b, as also explained in FIG. 1. Suitable sensors are used for measuring, in a direct or indirect manner, the angles 9*a*, 9*b* or the exposed length of a and b cables.

In particular, according to the embodiment shown in FIGS. 15 and 16, an exercise machine is indicated in its entirety by the reference number 500 and can comprise a single exercise module 510, as shown in FIG. 15, or a plurality of exercise modules 510 as shown in FIG. 16.

The exercise machine 500, or in particular at least one of the exercise modules 510, comprises:

- at least a gripping element 506;
- a first motor 536 configured to generate a first load source 501,
- a second motor 537 configured to generate a second load source 502,
- cable traction means 516 comprising a first cable branch a and a second cable branch b provided with respective and separate connection ends 517 attached to the gripping element 506, and with respective and separate traction ends 518, opposite the connection ends 517 and connected to the first motor 536 and respectively to the second motor 537 to receive the first load source 501 and respectively the second load source 502,
- a control and command unit 539 connected to said first motor 536 and said second motor 537 and configured to regulate said load source 501 and said second load source 502 and generate a resisting force with a constant intensity and direction perceived on the gripping element 506 during a traction exerted by a user U on the gripping element 506.

According to another aspect of the present invention, the exercise machine 500 comprises detection devices 541 connected to the control and command unit 539 and configured to detect the angulation of the first cable branch a and the second cable branch b, for example with respect to the horizontal. Merely by way of example, the detection devices 541 can be installed in a fixed position on the machine frame f.

The detection devices 541 can comprise at least one of either a photocell, a laser sensor, an inductive sensor, a capacitive sensor.

The control and command unit 539, detecting the angulation data of the first cable branch a and the second cable branch b, is able to instantly define the drive modes of the first motor 536 and the second motor 537 and therefore determine the intensity and direction of the resisting force R acting on the gripping element 506 and therefore perceived by the user U.

The first motor 536 and the second motor 537 can be provided, in the same way as described for the first motor 36 and the second motor 37, with respective control devices 38 with the function of controlling the twisting torque and therefore the force acting on each cable branch a, b.

In particular, it can be provided that the control devices 38 allow to control the force that the first motor 36 and the second motor 37 are able to oppose against the movement of the first cable branch a and the second cable branch b.

The control devices 38 can also be used to detect an electric absorption parameter of the motors 536 and 537, being able to determine in this way the entity and direction of the force generated by the user U on the gripping element 506.

According to a possible solution, the control and command unit 539 can be configured to maintain in each cable branch the intensity and direction of the force exerted.

According to the solution shown in FIG. 16, the exercise machine comprises two exercise modules 510 installed on a single machine frame f.

The machine frame f can comprise a platform p as described above, defined by a box-like body 27 in which at least the first motors 536 and the second motors 537 are housed.

There can be one control and command unit 539 to control the motors of both the exercise modules 510.

The control made by the control and command unit 39 or 539 can be carried out during the use of the exercise machine 100, 500.

In the non-actuated condition, the only parameter controlled is the intensity of the resisting force R, the angle of the resisting force is constant.

If the exercise machine 100, 500 is actuated, it is possible to implement, depending on the cases, different control modes, for example:

- controlling the resisting force R and its angle of perception of the force;
- controlling the resisting force R and the position of the carriage 4.

Different combinations of sensors and algorithms can be used to control the exercise machine behavior:

1) Resisting force R can be controlled by:
   - Measuring actual resisting force R with one load cell located between cable ends and the grip element 6. The measure is used in a closed control loop to drive each motor current.
   - Measuring forces F1 and F2, acting on the first cable branch a and on the second cable branch b, separately with 2 load cells to measure the tension of each cable or torque sensors measuring motor torque. The measures are used in a closed control loop to drive each motor current to get F1+F2=Ftot.
   - Feed forward control loop where frictions and inertias are known a priori or in a lookup table as function of load sources speed (V1 and V2), acceleration (and other parameters, like motor temperature) to estimate actual F1 and F2. Speed sensors on each load source are required to apply the tabulated corrections and build a control signal for each motor.
2) The perceived force angle can be controlled by:
   - As in 1.b, measuring F1 and F2 independently and controlling each motor current to keep the desired perceived force angle value, direct function of F1-F2.
   - Directly measuring the desired perceived angle with angle sensor located on the carriage and measuring the angle of the cable segments exiting from the carriage to reach the grip element.
   - As in 1.c, estimating actual F1 and F2 by tabulated frictions and inertias and controlling each motor current to keep the desired perceived angle value.
3) The position of the carriage 4 can be controlled by:
   - Transducer measuring actual carriage position. Measure is used in a closed control loop to drive each motor current.
   - Measuring the velocity V1 of the first load source and the velocity V2 of the second load source (e.g. with a tachometer coupled with motor shaft or measuring motors tension). The measure is used in a closed control loop to set V1=V2. This means that velocity of the carriage Vc=0 and the carriage position is kept constant at the initial value.
   - Measuring directly the position of the first 1 and second load source 2 (e.g. with an absolute encoder coupled with motor shaft). The carriage position is directly related to the position of the first 1 and second load source 2.

Possible combinations of controls are, for example:

$$-1\cdot a+2\cdot b+3\cdot a$$

$$-1\cdot b+2\cdot a+3\cdot b$$

$$-1\cdot c+2\cdot c+2\cdot b$$

$$-\ldots$$

The combination to be implemented depends on actual mechanisms inefficiencies or electric motor accuracy.

Figure 17:
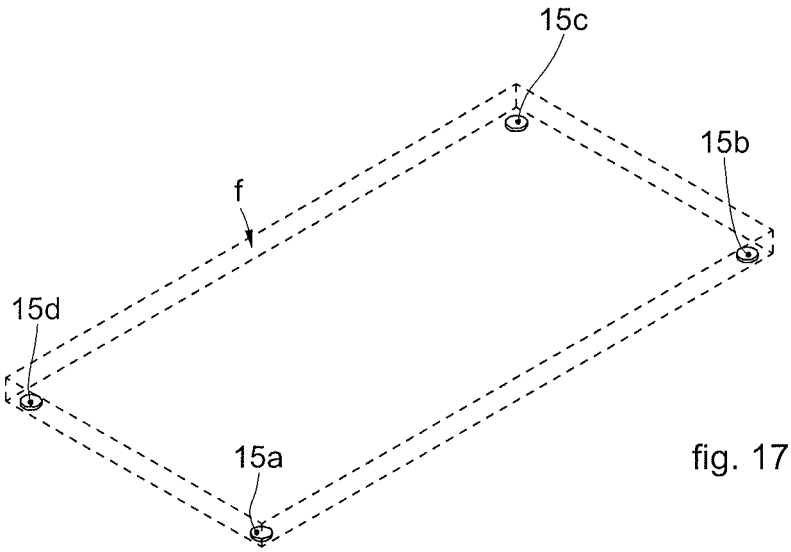
FIG. 17 shows a possible embodiment of a component of the machine of the present invention in accordance with possible embodiments.

FIG. 17 shows a safety system that ensures full stability of the machine, even in dynamic conditions (e.g. while the user completely supported on the machine frame is moving on it, or in case the user accidentally steps down from the machine frame while carrying a loaded grip element).

This safety system can be adopted in one or the other of the embodiments described here, and could also be adopted in muscular training machines.

The system comprises a certain number of force sensors 15*a*, 15*b*, 15*c*, 15*d* located under the machine frame f and completely supporting the entire machine on the ground g.

In particular, the sensors 15*a*, 15*b*, 15*c* and 15*d* are installed in the platform p on the side facing toward the support plane, and are configured to detect the weight of the user U acting on the platform p. The machine 100, or 500, also comprises an alarm system connected to the sensors 15*a*, 15*b*, 15*c* and 15*d* and configured to process the weight data detected and to supply an alarm signal whenever at least one of the data detected is lower than a determinate threshold.

Each of the force sensors 15*a*, 15*b*, 15*c*, 15*d* measures a weight greater than zero in normal and stable operation (if the user is completely supported on the machine frame, the sum of each measured weight, in static conditions, equals the weight of the user plus the weight of the machine, even if the resisting load is active). When at least one of the force sensors 15*a*, 15*b*, 15*c*, 15*d* detects a weight approaching zero, it means that the frame f is losing contact with the ground so an instability or an overturn risk is incipient (e.g. the user is losing his equilibrium) and the central computer of the machine can warn the user, shut down or regulate resisting load in order to maintain or recover system stability.

This feature avoids the need of a large support base and a heavy frame or to fix the device to the ground or to a walls.

We will now describe other embodiments of the present invention that can be combined with each other.

Embodiment 1

An exercise machine suitable for developing in a user U motor and functional abilities and muscular strength as well as for medical or rehabilitation purposes in which there is a machine frame f, p, grip elements 6 of a shape suitable for a body part, one or more cables a, b connected with the grip elements 6 and carrying resisting loads F, F1, F2 generated by load sources 1, 2 like weights stacks, resistance elements, pneumatic actuators or electric actuators. According to this embodiment the exercise machine comprises the machine frame f, p whereon a rail 3 is coupled for supporting a carriage 4 that slides along the rail and accommodates transmission means 5 that lead the cables a, b to the grip elements 6, one end of each cable being attached to the grip element 6 for a user's body part U and the other ends being connected with a respective load source 1, 2, the grip elements 6 being freely movable by the user U who perceives a resisting force R whose direction is substantially independent from user position and movements and depends on the forces F, F1, F2 exerted by the load sources 1, 2 and chosen by the user U.

Embodiment 2

The exercise machine according to embodiment 1 wherein the load sources 1, 2 exert forces F1, F2 such as to make a resistance R to the user movements and to position the carriage 4 so that the angle 9 of the cables a, b is dependent substantially only on said forces F1, F2 and the carriage 4 follows the user's movements 12 to keep constant said angle 9, the user U being able to move freely, perceiving the resisting force R directed according to the angle 9.

Embodiment 3

An exercise machine suitable for developing in a user motor and functional abilities and muscular strength as well as for medical or rehabilitation purposes which comprises a machine frame f, grip elements 6 of a shape suitable for a body part, one or more cables a, b connected with the grip elements 6 and carrying resisting loads F1, F2, generated by load sources 1, 2, like weights stacks, resistance elements, pneumatic actuators or electric actuators and characterized in that it comprises two resisting load sources 1, 2 acting on two cables a, b linked to the grip element 6, said resisting load sources exerting an amount of force F1, F2 such as to make a resistance to the user movements and to keep the angle of the resisting force R perceived at the grip element 6 at the desired value, the forces F1, F2 being dependent on the angles 9*a*, 9*b* of each cable a, b.

Embodiment 4

An exercise machine, suitable for developing in a user motor and functional abilities, muscular strength and suitable for medical or rehabilitation purposes, which comprises a machine frame f, at least one grip element 6 suitable for a body part, each of the grip elements linked to one or more cables a, b carrying a resisting load 1, 2 generated through load sources embodied through electric motors coupled, directly or through a transmission system suitable for increasing the torque, to a spool where a cable is wound and unwound, transmitting the resisting load to the grip element, comprising conventional means for controlling the electric motors characterized in that said motors are of a non-conventional type like pancake motors, hub motors, or external rotor motors and are used for generating the resisting load and reading user gestures, in the form of specific movements, applied to the grip element 6, recognizable by the machine, made for controlling the machine behavior, which comprises changing the resisting force value.

Embodiment 5

The exercise machine according to embodiment 4 wherein the electric motors used as load sources are conventional motors coupled with a planetary geared to increase the torque and the spool being directly coupled to the geared shaft, resulting in a long, slender and coaxial design suitable for installation in thin spaces.

Embodiment 6

The exercise machine, suitable for developing in a user motor and functional abilities, muscular strength and suitable for medical or rehabilitation purposes, which comprises a machine frame f, at least one grip element 6 suitable for a body part, each of the grip elements linked to one or more cables a, b carrying a resisting load, the resisting load being generated through load sources suitable for being electronically controlled characterized in that at least one of the grip elements 6 acts as input device and user interface to the machine through conventional control means suitable for activating, deactivating and changing the resisting load F according to a user action and through visual, acoustic or tactile feedback means, some or all of those means being located on the grip element itself.

Embodiment 7

The exercise machine according to embodiment 6 wherein at least one of the grip elements 6 also comprises sensors suitable for measuring user biometric data such as heart rate, blood oxygen concentration and grip element motion data.

Embodiment 8

An exercise machine, suitable for developing in a user motor and functional abilities, muscular strength and suitable for medical or rehabilitation purposes, which comprises a machine frame f, at least one grip element 6 suitable for a body part U, each of the grip elements linked to one or more cables a, b carrying a resisting load generated through load sources suitable for exerting a force on a cable, like weights stacks, resistance elements, pneumatic actuators or electric actuators characterized in that a safety system recognizes a machine instability by a plurality of force sensors 15 located under the machine frame f and completely supporting the entire machine on the ground g, each of the force sensors measuring a force greater than zero in normal and stable operation and at least one of the force sensors 15 measuring a force approaching zero in case of incipient instability or overturn of the machine, the measure being used to warn the user U or regulate the resisting load sources.

Embodiment 9

The exercise machine according to embodiments 1-3, 5, 7, 8 characterized in that it comprises:

a machine frame f, whereon at least one rail 3 is coupled and supports a carriage 4 that slides along the rail that accommodates transmission means 5 suitable for leading the cables a, b to grip elements 6, grip elements 6*a*, 6*b* at least one of them acting as input device and user interface to the machine, each of them being connected with a respective cable a, b, load sources 1, 2 as electric motors suitable for generating the resisting load F and for reading gestures that the user makes for controlling the machine behavior and the resisting load magnitude and direction, a safety system 15 suitable for detecting a machine instability, warn the user or regulate the resisting load sources 1, 2.

It is clear that modifications and/or additions of parts may be made to the exercise machine 10 as described heretofore, without departing from the field and scope of the present invention.

It is also clear that, although the present invention has been described with reference to a specific example, a person of skill in the art shall certainly be able to achieve many other equivalent forms of containing exercise machine 10, having the characteristics as set forth in the claims and hence all coming within the field of protection defined thereby.

The invention claimed is:

1. A machine for gymnastic exercises comprising:

a sliding rail (3), a carriage (4) installed in a sliding manner, and free to slide, on the sliding rail (3), a first pulley (21) and a second pulley (22) installed on the carriage (4) and rotatable in an idle manner around respective axes of rotation, a gripping element (6), cable traction means (16) comprising a first cable branch (a) and a second cable branch (b) provided with respective and separate connection ends (17) attached to the gripping element (6), the first cable branch (a) and the second cable branch (b) wind at least partly around the first pulley (21) and respectively the second pulley (22) to define first return segments (23) comprised between said gripping element (6) and respectively said first pulley (21) and second pulley (22), and second return segments (24) that extend one on a first side (25) and the other on a second side (26), opposite the first side (25), of the carriage (4) and substantially parallel to the sliding rail (3), wherein first load sources (1) and second load sources (2) are associated respectively with the second return segments (24) of the first cable branch (a) and of the second cable branch (b), said load sources (1, 2) being configured to generate a resisting force (R) with constant intensity and direction perceived on the gripping element (6) during a traction exerted by a user (U) on the gripping element (6), in that said first load source (1) and said second load source (2) comprise respectively a first motor (36) and a second motor (37) suitable to generate, in the first cable branch (a) and in the second cable branch (b), a force resistant to the force exerted by the user (U), and in that the first motor (36) and the second motor (37) are provided with respective control devices (38) provided to control the force that the first motor (36) and the second motor (37) generate to oppose against the movement of the first cable branch (a) and the second cable branch (b).

2. The machine as in claim 1, wherein said control devices (38) are connected to a control and command unit (39) configured to coordinate the drive of said first motor (36) and said second motor (37) and to determine the entity of a first force (F1) and a second force (F2) imparted in said first cable branch (a) and said second cable branch (b).

3. The machine as in claim 2, further comprising an interface device (40) connected to said control and command unit (39) and with which the user (U) interacts to command specific execution modes of the exercises, said commands supplied by means of said interface device (40) being configured to determine the drive mode of the first motor (36) and the second motor (37).

4. The machine as in claim 3, wherein said interface device (40) is associated with said gripping element (6).

5. The machine as in claim 2, wherein said control and command unit (39) is configured to receive data, corresponding to respective stresses acting on said first cable branch (a) and said second cable branch (b), from detectors, to process said data, to identify gestures made by the user (U) and to compare said gestures with predefined movement patterns memorized in said control and command unit (39), a specific functioning command of the machine being associated with each predefined movement pattern.

6. The machine as in claim 1, further comprising it comprises detection devices (41) configured to detect at least one of either a position of the carriage (4) along the sliding rail (3) or an angulation of the first return segments (23) with respect to the second return segments (24).

7. The machine as in claim 1, wherein said sliding rail (3) is installed, with respect to a machine frame (f), rotatable around an axis of rotation (X) parallel to a longitudinal extension of the sliding rail (3).

8. The machine as in claim 1, wherein said sliding rail (3) is selectively rotatable around a second axis of rotation (Y) orthogonal to a longitudinal extension of said sliding rail (3).

9. The machine as in claim 1, further comprising a machine frame (f) provided with a platform (p) configured to support said user (U), in that sensors (15*a*, 15*b*, 15*c*, 15*d*) are associated with said platform (p) and configured to detect the weight of said user (U) on said platform (p), and further comprising an alarm system connected to said sensors (15*a*, 15*b*, 15*c*, 15*d*) and configured to process weight data detected and to supply an alarm signal whenever at least one of said data detected is below a determinate threshold.

* * * * *